United States Patent [19]

Nohtomi et al.

[11] Patent Number: 4,998,318

[45] Date of Patent: Mar. 12, 1991

[54] KNOB DEVICE

[75] Inventors: Nobuo Nohtomi; Hideaki Saito, both of Saitama, Japan

[73] Assignee: Pioneer Electronic Corporation, Tokyo, Japan

[21] Appl. No.: 426,645

[22] Filed: Oct. 26, 1989

[30] Foreign Application Priority Data

| | | | |
|---|---|---|---|
| Mar. 10, 1989 | [JP] | Japan | 64-26586[U] |
| Mar. 10, 1989 | [JP] | Japan | 64-26587[U] |
| Mar. 10, 1989 | [JP] | Japan | 64-26588[U] |

[51] Int. Cl.[5] ..... E05B 1/00

[52] U.S. Cl. ..... 16/121; 362/295; 362/802; 362/86; 200/344; 200/345

[58] Field of Search ..... 16/121, DIG. 30; 74/553; 362/394, 23, 85, 86, 295, 802; 340/806; 250/465.1; 200/341, 344, 345, 520

[56] References Cited

U.S. PATENT DOCUMENTS

| | | | |
|---|---|---|---|
| 2,242,165 | 5/1941 | Batcheller | 362/394 |
| 2,681,980 | 6/1954 | Harrington | 362/85 |
| 2,855,229 | 10/1958 | Winslow | 74/553 |
| 3,170,057 | 2/1965 | Kane et al. | 362/295 |
| 3,619,594 | 11/1971 | Morez | 74/553 |
| 3,724,281 | 4/1973 | Dorchester | 74/553 |
| 4,827,243 | 5/1989 | Cheng | 200/345 |
| 4,871,890 | 10/1989 | Herrera | 200/341 |
| 4,930,048 | 5/1990 | Ito | 362/85 |

FOREIGN PATENT DOCUMENTS

| | | |
|---|---|---|
| 3521155 | 12/1986 | Fed. Rep. of Germany . |
| 187719 | 7/1989 | Japan . |

*Primary Examiner*—Richard K. Seidel
*Assistant Examiner*—Chuck Y. Mah
*Attorney, Agent, or Firm*—Sughrue, Mion, Zinn, Macpeak & Seas

[57] ABSTRACT

A knob device mounted on an operating member such as an on/off switch or volume control of a piece of audio or video equipment has a push button which is pushed from the front side of a panel. The push button has a flange which is received in an escutcheon having an inner flange at its front end. A sheet having small projections on at least one of its inner and outer peripheries is disposed between the inner flange and the flange of the push button, as well as between the push button and the escutcheon, thereby to prevent any play or backlash from occurring. The sheet may be thin and interposed between the flange of the push button and the inner surface of the escutcheon in sliding contact with the flange. The knob device may be made of a light transmitting resin mounted on the operating element. The knob has a flange and a mark on its face formed by a non-light transmitting panel. The panel has a non-light transmitting knob guide formed on its rear to guide the flange. The guide covers at least a peripheral surface of the knob. A light-guiding member guides light rays to the rear face of the knob. A lamp may be provided to direct light rays directly to the knob.

18 Claims, 4 Drawing Sheets

KNOB DEVICE

BACKGROUND OF THE INVENTION

This invention relates to an improvement in audio and video equipment generally, and in particular to an improved knob adapted to be mounted on an operating member, such as an on/off switch or a volume control, to be pushed, depressed, or rotated from the front side of a panel for operation. The invention also relates to an improved stem-mounted knob, which is mounted on a stem of an operating member, such as an on/off switch or a volume control, and having an illumination device provided thereon to provide bright indication of a mark on the front end face of the knob.

In a conventional knob device of this type, an escutcheon 2 is formed on the back side of a front panel 1, as shown in FIGS. 11 and 12. A push button 5, mounted on a stem 4 which is slidable back and forth relative to an operating member 3, such as an on/off switch or a volume control, is slidably received in the escutcheon 2, with its front end projecting outwardly from the front face of the front panel 1.

The push button 5 is depressed from the front side of front panel 1 to operate the operating member 3. By depressing the push button 5 again, the push button 5 is returned so as to project from the front face of the front panel 1, so that the operating member 3 also is returned to its initial condition.

In such a knob device, if an operator of the device feels play or backlash when the push button 5 is depressed, the operator may get the impression that the equipment is of low quality, and may have a disagreeable feeling toward the operation.

If play between the operating member 3 and its stem 4 and play between the push button 5 and the escutcheon 2 both are eliminated, an improper operation, such as an improper returning movement of the push button 5, would be encountered with even a slight error in assembly.

For this reason, conventionally, only one of the occurrences of play present respectively between the operating member 3 and the stem 4 and between the push button 5 and the escutcheon 2 has been eliminated. The other occurrence play is left unchanged.

However, in this case, the method of reducing the play between the push button 5 and the escutcheon 2 is limited. Therefore, depending on the assembly accuracy, the push button 5 may not return properly, and the push button 5 may impinge on the escutcheon 2 because of vibration, thereby producing noise.

Further, the reduction of the play between the operating member 3 and the stem 4 causes a drawback in that the impression of high quality is lost because the gap between the escutcheon 2 and the push button 5 can be viewed from the front side.

Another problem with the conventional knob device is shown in FIG. 13, in which reference numerals are used similar to those used in FIGS. 11 and 12 to denote like elements. A conventional knob incorporating an illumination device of this type has a volume element 3 of the pop-up type which is turned on once it is depressed and is returned to its initial position (turned off) when depressed again. A knob made of a light-transmitting resin is mounted on the front of a stem 4 of the volume element.

White paint is coated on at least the f end face of the knob 5, and then a non-light-transmitting for example, black paint, is coated on the front end so as to provide a mark 5*a*′, such as a character or a figure, as a mortise.

The knob 5 is projected outwardly the front face of the panel 1 so that the knob 5 can be pushed, and in the same manner as described above, a mark 1*a*′, such as a character or a figure, also is provided on the front of the panel 1 either above or below a hole 1*b*′ thereof through which the knob 5 is passed.

A light-guiding member 8 made of light-transmitting resin is mounted on the rear face of the panel 1 facing away from the mark 1*a*′, the light-guiding member a projection 8*a* projecting so as to face the rear end of knob 5.

With this construction, a light ray a light source (not shown) such as a lamp is guided b light-guiding member 8 to the mark 1*a*′ on the panel 1 to it. Also, the light ray from the projection 8*a* of the light-guiding member 8 brightens the rear end of the knob 5, and this light transmits through the knob 5 to brighten the mark 5*a*′.

In such a knob with an illumination device, if a gap between the knob 5 and the hole 1*b*′ through which the knob 5 passes is too small, the knob 5 contacts the edge of this hole so that the frictional resistance to the movement of the knob 5 is increased, possibly causing an improper returning movement of the knob 5.

For this reason, the gap is designed- to be relatively large, and as a result leaking light emitted from the light-guiding member 8 toward the peripheral surface of the knob 5 can be viewed through this gap, which results in degrading of equipment design, and thus providing an impression of low quality.

In view of the foregoing, it is one object of the invention to provide a knob device in which it is unnecessary to eliminate the play present respectively between the operating member and its stem and between the push button and the escutcheon. With the present invention, even when there is a certain degree of variation in assembly accuracy, the operator does not feel the play or backlash, and there is no risk of improper operation.

It is another object of the present invention to prevent leakage of light applied to the outer periphery of the knob. As a result, even if the gap between the knob and the knob-passing hole in the panel is increased, the light will not leak out, thereby ensuring an impression that the equipment is of high quality.

SUMMARY OF THE INVENTION

In the invention, a sheet is disposed between a flange formed on a push button, mounted on an on/off switch or a volume control, and an inner flange provided at an escutcheon of a panel. The sheet is interposed between the push button and the escutcheon, and has a plurality of small projections formed on at least one of the inner and outer peripheries of the sheet.

A second embodiment of the invention has a thin sheet interposed between a flange formed on a push button, mounted on an on/off switch or a volume control, and an escutcheon formed on the back side of a panel. The flange is disposed in sliding contact with the inner surface of the thin sheet so as to eliminate play between the push button and the escutcheon, and to achieve a smooth movement of the push button. According to this embodiment, the sheet does not have to be stamped from a die.

A third embodiment of the present invention relates to a knob incorporating an illumination device for achieving the above object, in which a flange is formed on a light-transmitting knob mounted on a stem of an operating member such as an on/off switch or a volume control. The knob has a mark on its front end face, and a knob guide is formed on the rear face of a panel through which the knob is passed. The knob guide surrounds the outer periphery of the knob, and a light-guiding member serves to guide light rays from a light source to the rear end face of the knob.

BRIEF DESCRIPTION OF THE DRAWINGS

The above and other objects, features, and advantages of this invention will become more apparent from the following detailed description when read in conjunction with the accompanying drawings in which.

DETAILED DESCRIPTION OF THE PREFERRED EMBODIMENTS

One embodiment of the present invention will now be described with reference to FIGS. 1 to 3.

Figure 1:
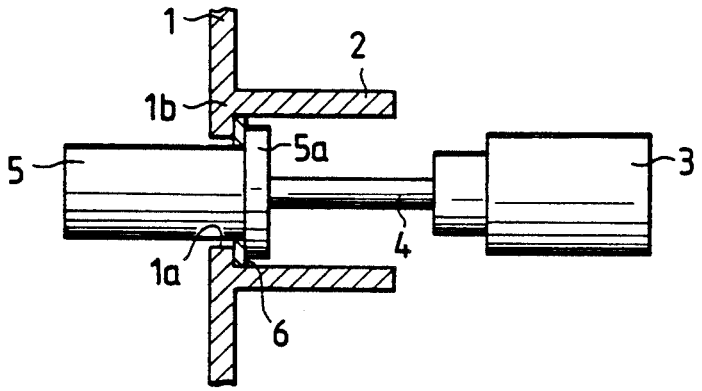
FIG. 1 is a side-elevational view of one embodiment of the present invention.
Figure 2:
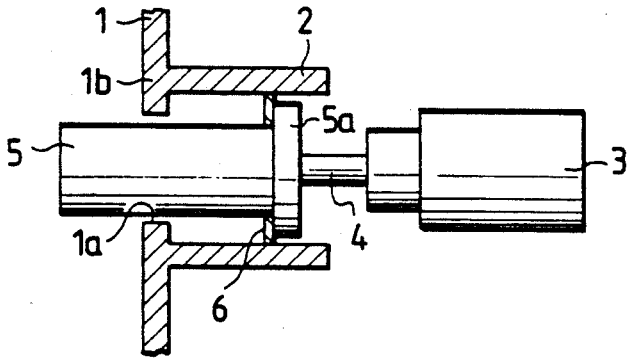
FIG. 2 is a side-elevational view of this embodiment in a pushed condition.

Referring to FIGS. 1 and 2, a front panel 1 has an escutcheon 2 formed at the back side thereof, and an operating member 3 such as an on/off switch or a volume control is shown. A push button 5 is mounted on a stem 4 of the operating member 3. By depressing the push button 5 toward the rear side of the escutcheon 2 (FIG. 2), the operating member 3 is operated, similarly to a conventional push button knob device.

A hole 1*a* is formed through the front panel 1 coaxially with the escutcheon 2, and that portion of the front panel 1 disposed around the periphery of the hole la serves as an inner flange 1*b*.

A radially outwardly-directed flange 5*a* is formed on the rear end of the push button 5, and the flange 5*a* is slidably moved within the escutcheon 2. There is a suitably large gap between the flange 5*a* and the escutcheon 2, as well as between the inner flange 1*b* and the push button 5.

Figure 3:
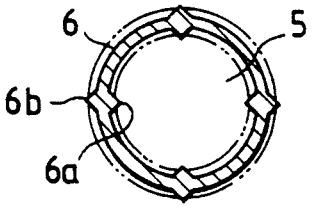
FIG. 3 is a plan view of a sheet used in the invention.
Figure 4:
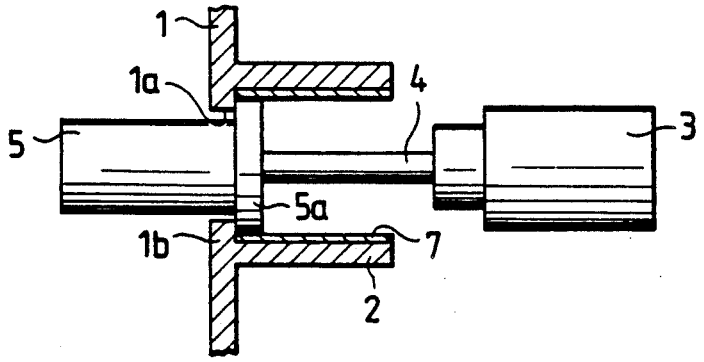
FIG. 4 is a side-elevational view of a second embodiment of the invention.
Figure 5:
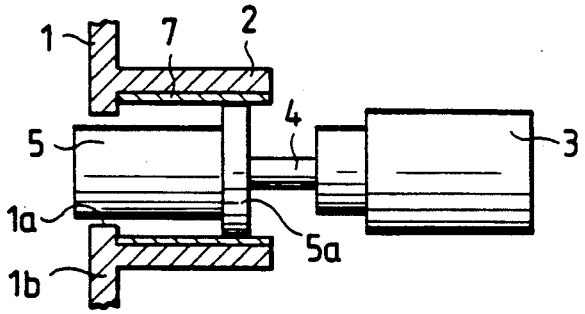
FIG. 5 is a side-elevational view of this second embodiment in a depressed condition.
Figure 6:
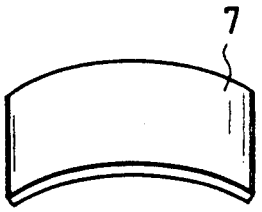
FIG. 6 is a perspective view of a sheet used in the invention.

Referring to FIG. 3, a ring-shaped sheet member 6 which is slightly flexible and is made, for example, of vinyl chloride, has a plurality of small projections 6*a* and a plurality of small projections 6*b* which are formed on the inner and outer peripheries, respectively, of the sheet member 6.

The sheet member 6 is fitted on the push button 5 and is disposed between the inner flange 1*b* and the flange 5*a*. Therefore, the small projections 6*a* are in contact with the push button 5, and the small projections 6*b* are in contact with the inner surface of the escutcheon 2. The areas of contact of these projections are small, and therefore their frictional resistances are small.

Therefore, the sliding movement of the push button 5 toward the rear side upon depression of the push button 5 from the front side, as well as the sliding movement of the push button 5 toward the front side of the front panel 1 when depressing the push button 5 again, can be effected smoothly without receiving a large resistance Thus, there will be no improper operation caused by improper movement of the push button.

In addition, the small projections 6*a* and 6*b* are always held in contact with the push button 5 and the inner surface of the escutcheon 2, respectively. Therefore, the push button 5 is not shaken within the escutcheon 2 even when the equipment is subjected to vibration. Hence, the push button 5 does not impinge on the escutcheon 2, thus eliminating the risk of producing noise.

Simultaneously, the play of the push button 5 will not be felt disagreeably through the operator's finger operating the push button, so that an impression of high quality is retained.

In the above embodiment, the small projections 6*a* and 6*b* are provided on the inner and outer peripheries of the ring-shaped sheet, respectively. However, the small projections may be provided on only one of the two peripheries by suitably determining the height of the small projections, the elasticity of the material, the thickness, etc., in which case the other periphery on which the small projections are not provided are held in intimate contact with the push button 5 or the escutcheon 2. In this case, similar effects can be achieved as described above.

As described above, since the ring-shaped sheet member having the plurality of small projections is interposed between the push button and the escutcheon, the small projections are slidably movable relative to the inner surface of the escutcheon and the surface of the push button. Therefore, the frictional resistance caused by such sliding movement is small.

Therefore, when operating and returning the push button, the push button can be moved smoothly without feeling play, and there is no improper operation or the like.

Moreover, since this sheet member absorbs the play between the escutcheon and the push button, the dimensional accuracies of the parts and the assembly accuracy are not so critical, so that manufacture is easy.

Figure 7:
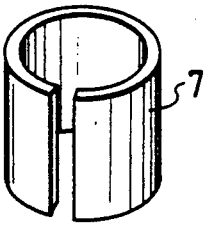
FIG. 7 is a perspective view of the sheet in its rolled condition.

Referring to FIGS. 4 to 8, a second embodiment of the knob device is described hereinafter in which a thin flat sheet 7 which is made, for example, from a polyester sheet having a thickness of 0.18 mm, is formed or rolled into a tubular shape and is inserted into the escutcheon 2, as shown in FIG. 7. The flange 5*a* of the push button 5 is disposed in sliding contact with the inner surface of the thin sheet 7.

Figure 8:
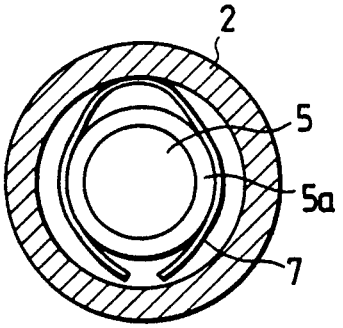
FIG. 8 is a cross-sectional view of the sheet inserted in an escutcheon.

The inner flange 1*b* prevents the thin sheet 7 from disengagement toward the front side of the front panel 1. The thin sheet 7 inserted into the escutcheon 2 has a distorted circular shape, as shown in FIG. 8.

Therefore, the flange 5*a* does not contact the thin sheet 7 over the entire outer periphery of the flange 5*a*, and only part of the flange 5*a* contacts the thin sheet 7. Because of the synergistic effect of the resilient force, under which the deformed circular shaped-portion of the thin sheet 7 (which has been brought close to an accurately circular shape by contact with the flange 5*a*) tends to return to its original shape, light frictional resistance is obtained between the flange 5*a* and the thin sheet 7.

As a result, the movement of the push button 5 upon depressing the push button 5 from the front, as well as the returning movement of the push button 5 toward the front when pushing the push button 5 again, can be effected lightly and smoothly. Thus, the possibility of the push button being caught or impeded during its movement, an unfavorable operating feeling due to an increased frictional resistance, as well as an improper returning movement thereof are prevented.

Since the flange 5*a* of the push button 5 is supported resiliently because of the above-mentioned deformation of the thin sheet 7, play is not felt when operating the push button 5, and the push button 5 and the flange 5*a* will not impinge on the inner flange 1*b* of the escutcheon 2 even when the equipment is subjected to vibration. Thus, the risk of producing noise is eliminated.

As described above, the thin sheet, rolled into a tubular shape, is interposed between the flange of the push button and the escutcheon, and the deformed circular inner surface of the thin sheet is in contact with the accurately circular periphery of the flange, so that the push button can be operated lightly and smoothly. As a result, operating feeling can be improved, and an improper operation such as an improper returning movement can be prevented. Additionally, noise due to play and backlash will not be produced.

Further, the play between the push button (and its flange) and the escutcheon is absorbed by the distorted circular deformation of the thin sheet. Therefore, as before, the requirements for the dimensional accuracies of the parts and the assembly accuracy are less strict, so that the manufacturing control parameters can be loosened.

Further, the thin sheet only needs to be cut into a rectangular shape, and it does not need to be formed by stamping. This provides many advantages including the lowering of the cost of the thin sheet.

Figure 9:
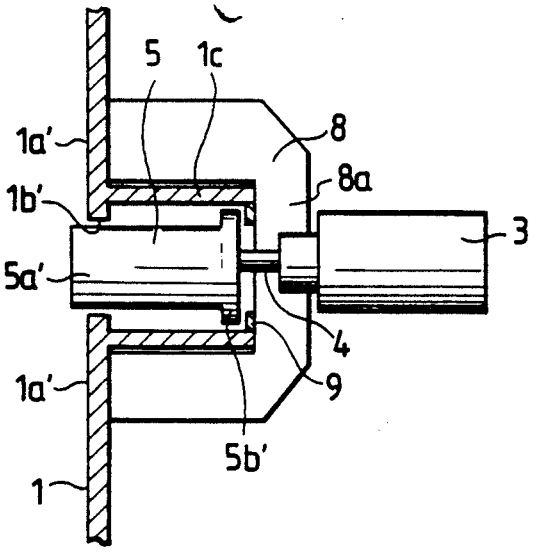
FIG. 9 is a cross-sectional view of a third embodiment of the invention incorporating an illumination device.

Hereinafter, a third embodiment of the present invention will be described having illumination capabilities, as shown in FIG. 9, in which a volume element 3 of the popular type with stem 4 thereof is connected to a knob 5 having a mark 5*a*′ on its front end face. A panel 1 has a hole 1*b*′ through which the knob 5 is passed, and has a mark 1*a*′, as is the case with the above-mentioned knob with a conventional illumination device.

The knob 5 has a flange 5*b*′ formed on the rear end thereof. A knob guide 1*c* of a non-light-transmitting nature for guiding the movement of the flange 5*b*′ is formed on the rear face of the panel 1 in such a manner as to cover the entire outer periphery of the knob 5.

A transparent light-guiding member 8 for guiding light from a lamp (not shown) is mounted on the rear face of the panel 1 facing away from the mark 1*a*′. The light-guiding member 8 has a projection 8*a* projecting toward the rear end of the knob 5, as is the case with the conventional device. A non-light-transmitting sheet 9 is bonded to the outer peripheral portion of the front face of the projection 8*a*.

With this arrangement, the light ray of the lamp guided by the light-guiding member 8 reaches the mark 1*a*′ on the panel 1 to brighten its mortise portion so that it can be viewed easily, even during the night. This also improves the appearance of the panel 1.

Simultaneously, the light ray of the lamp is applied from the projection 8*a* of the light-guiding member 8 to the knob 5 to illuminate the knob 5, and this light brightens the mortise portion of the mark 5*a*′ on the knob 5, thus achieving the same effect as described above for the mark 1*a*′.

At this time, since the knob guide 1*c* is provided around the knob 5, the light does not leak from the light-guiding member 8 to the knob 5. Further, since the sheet 9, bonded to the outer peripheral portion of the front face of the projection 8*a*, prevents the light from leaking through the outer periphery of the flange 5*b*′, such leakage light will not be viewed through the gap between the knob 5 and the hole 1*b*′ in the panel 1, thus preventing a poor appearance. This also prevents the brightness of the marks 5*a*′ and 1*a*′ from being reduced.

Since the knob guide 1*c* also serves to guide the flange 5*b*′ of the knob 5, the knob 5 can be moved smoothly.

Figure 10:
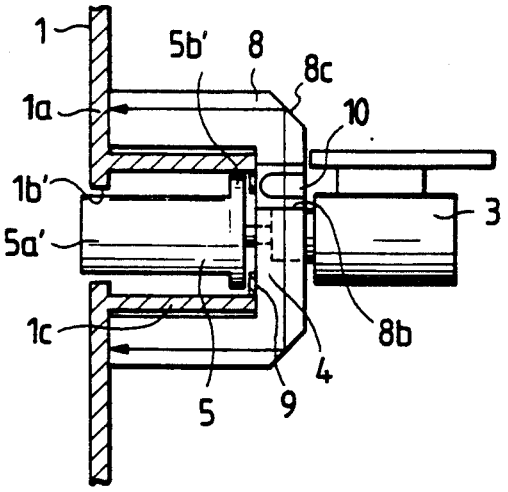
FIG. 10 is a cross-sectional view of a fourth embodiment of the invention incorporating an illumination device.
Figure 11:
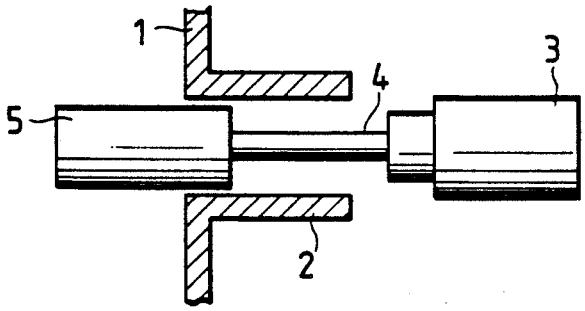
FIG. 11 PRIOR ART
FIG. 11 is a side-elevational view of a conventional knob device.
Figure 12:
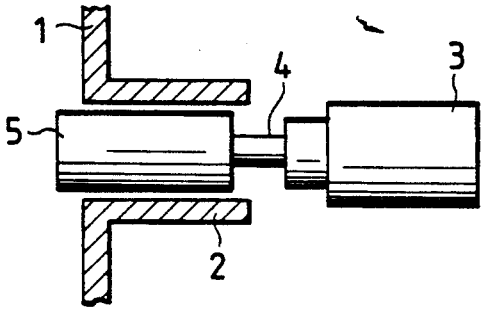
FIG. 12 PRIOR ART
FIG. 12 is a side-elevational view of this conventional device in a depressed condition.
Figure 13:
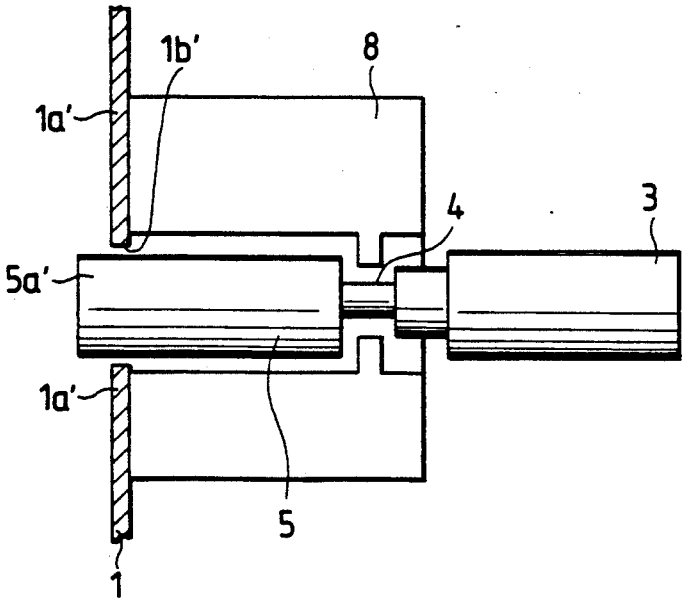
FIG. 13 PRIOR ART
FIG. 13 is a cross-sectional view of a conventional knob with a conventional illumination device.

In another embodiment shown in FIG. 10, a lamp hole 8*b* is formed through the projection 8*a*. A lamp 10 is received in this lamp hole, so that the light from this lamp can directly reach the knob 5. A reflection inclined surface 8*c* is formed on the outer surface of the light-guiding member 8 so as to reflect the light, emitted from the lamp 10, toward the mark 1*a*′.

The present invention is applicable to a push button switch of the double push type, a rotary volume element, a switch or the like, in addition to the above-mentioned volume element of the pop-up type.

As described above, in the present invention, since the knob guide of a non-light-transmitting nature is provided between the outer peripheral surface of the knob and the light-guiding member, the light is prevented from leaking from the light-guiding member toward the outer periphery of the knob. Therefore, no leaking light will be viewed through the gap between the knob-passing hole in the panel and the knob.

Therefore, the loss of an impression of high quality because of leaking light, as well as the loss of the appearance of the marks on the knob and the panel and the loss of easy recognition of the marks because of the reduction of the brightness of the marks, will not be encountered. Another advantage is that play in the knob, and improper returning movement felt by the operator's finger when operating the knob, are improved by the knob guide which guides the knob.

While certain preferred embodiments have been shown and described, many changes and modifications within the spirit of the invention will be apparent to those of working skill in this technical field. For example, it is considered to be within the scope of the invention to combine the features of the embodiment of FIGS. 1–3 with those of the embodiment of FIGS. 4–8. The resulting structure would have first and second flange portions as described above, with projections on a sheet disposed between the escutcheon and the first and second flange portions. This combined structure, or the structure of either of the first two described embodiments, could be provided with an illumination device according to the embodiment of FIGS. 9 and 10. Thus, the scope of the invention should be considered as limited only by the appended claims.

What is claimed is:

1. A knob device, comprising:

an operating member;

a push button mounted on said operating member and having a first flange;

an escutcheon in which said first flange is received, said escutcheon having a second, inner flange at its front end which contacts said first flange; and a sheet disposed between said first flange and said second flange and interposed between said push button and said escutcheon, said sheet having a plurality of small projections formed on at least one of inner and outer peripheries of said sheet.

2. A knob device as defined in claim 1, wherein said first flange is directed radially outwardly.

3. A knob device as defined in claim 1, wherein said sheet comprises a flexible material.

4. A knob device as defined in claim 3, wherein said material is vinyl chloride.

5. A knob device as defined in claim 1, wherein said sheet comprises a ring-shaped material.

6. A knob device, comprising:

an operating member;

a push button mounted on said operating member, and having a first flange;

an escutcheon formed on the rear side of a front panel, said first flange being received in said escutcheon; and a thin sheet interposed between the inner surface of said escutcheon and said first flange, said first flange being disposed in sliding contact with an inner surface of said thin sheet.

7. A knob device as defined in claim 6, wherein said sheet comprises a tubularly-shaped material.

8. A knob device as defined in claim 7, wherein said sheet has a shape which is deformed when inserted into said escutcheon.

9. A knob device as defined in claim 6, wherein an outer periphery of said first flange contacts a portion of said sheet.

10. A knob device as defined in claim 6, wherein said sheet comprises a rectangularly-shaped material.

11. A knob device as defined in claim 10, wherein said sheet material comprises polyester.

12. A knob device as defined in claim 6, wherein said escutcheon has a second, inner flange at its front end which contacts said first flange.

13. A knob device, comprising:

an operating member;

a knob comprising a light-transmitting resin and mounted on a stem of said operating member, said knob having a first flange and having at a front end face thereof a mark formed by a non-light-transmitting paint;

a panel having a non-light-transmitting knob guide formed on a rear face of said panel so as to guide said first flange, said knob guide covering at least a peripheral surface of said knob, and said knob being projected outwardly from a front face of said panel;

a light-guiding member comprising a light-transmitting resin for guiding light rays from a light source to at least a rear end face of said knob; and a sheet bonded to an outer peripheral portion of a front face of said light-guiding member.

14. A knob device as defined in claim 13, wherein said light rays are provided simultaneously to said knob and said light-guiding member.

15. A knob device as defined in claim 13, further comprising an escutcheon, formed on a rear side of said panel, in which said first flange is received, said escutcheon having a second, inner flange at its front end which contacts said first flange.

16. A knob device, comprising:

an operating member;

a knob comprising a light-transmitting resin and mounted on a stem of said operating member, said knob having a first flange and having at its front end face a mark formed by a non-light-transmitting paint;

a panel having a non-light-transmitting knob guide formed on a rear face of said panel so as to guide said first flange, said knob guide covering at least a peripheral surface of said knob, and said knob having projected outwardly from a front face of said panel;

a light-guiding member of a light-transmitting resin for guiding light rays from a light source to at least a rear end face of said knob;

a lamp positioned in a lamp hole being formed through a projection to emit said light rays directly to said knob; and a sheet bonded to an outer peripheral portion of a front face of said light-guiding member.

17. A knob device as defined in claim 16, wherein said light guiding member has a reflective inclined surface formed on an outer surface of said light guiding member.

18. A knob device as defined in claim 16, further comprising an escutcheon, formed on the rear side of said panel, in which said first flange is received, said escutcheon having a second, inner flange at its front end which contacts said first flange.

* * * * *